United States Patent [19]

Girag

[11] Patent Number: 4,681,057

[45] Date of Patent: Jul. 21, 1987

[54] PUMPING SYSTEM FOR SHIPS

[76] Inventor: David Girag, 355 W. Windsor Rd., Glendale, Calif. 91204

[21] Appl. No.: 710,913

[22] Filed: Mar. 12, 1985

[51] Int. Cl.[4] ..... B63B 13/00

[52] U.S. Cl. ..... 114/183 R; 114/184; 440/38

[58] Field of Search ..... 114/173, 174, 176, 182–186, 114/197, 198; 440/38, 88

[56] References Cited

U.S. PATENT DOCUMENTS

| | | | |
|---|---|---|---|
| 1,162,223 | 11/1915 | Cram | 114/184 |
| 1,470,191 | 10/1923 | Reid | 114/183 R |
| 2,977,922 | 4/1961 | Skovranek | 114/183 A |
| 3,036,541 | 5/1962 | Musick et al. | 114/197 |
| 3,273,333 | 9/1966 | Roulund | 114/184 |
| 3,613,630 | 10/1971 | Jacuzzi | 114/184 |
| 3,763,817 | 10/1973 | Francis | 114/183 R |
| 3,946,694 | 3/1976 | Belsky | 114/183 R |
| 4,340,006 | 7/1982 | Patriarca et al. | 114/183 R |

*Primary Examiner*—Jeffrey V. Nase
*Assistant Examiner*—Stephen P. Avila
*Attorney, Agent, or Firm*—Lyon & Lyon

[57] ABSTRACT

A system for employing the propulsion system of a boat for bilge pumping. A tube surrounds the submerged propeller of the boat and extends forwardly to an inlet beneath the boat. An opening through the hull of the boat is provided in communication with the tube. A door controls communication between the hull and tube and alternatively between the inlet and the tube. A float within the hull controls the door depending on the level of water within the hull. A flow sensor locks the door in the closed position when flow is not experienced through the tube to the propeller.

3 Claims, 3 Drawing Figures

PUMPING SYSTEM FOR SHIPS

BACKGROUND OF THE INVENTION

The field of the present invention is mechanisms for the extraction of water from a ship's hull.

Boats and ships, hereinafter referred to generically as ships, are normally propelled by means of one or more propellers submerged in the water beneath the hull. Such propellers are generally driven by a substantial power plant commensurate with the size of the ship.

By comparison, pumping systems for pumping out bilges typically employ a much smaller power source than that employed for the propulsion system. As a result, when a major breach in the hull is experienced, such vessels tend to be incapable of remaining afloat. Consequently, a more powerful pumping system is advantageous. However, the additional cost, weight and space needed for a pumping system capable of meeting major disaster has generally ruled out truly adequate pumping systems.

SUMMARY OF THE INVENTION

The present invention is directed to a pumping system which employs the primary propulsion power plant. A submerged propeller on the ship normally employed for propulsion is positioned within a tube extending forwardly therefrom. An opening through the hull of the ship is in communication with that tube with a door controlling the communication between the interior of the hull and the tube. During a major breach of the hull, the propulsion system continues to propel the ship while drawing water from the interior of the hull at a rapid rate.

Through the use of such a system, additional power plant capacity is not required. Consequently, additional costs are minimal and little additional space and weight is required.

Accordingly, it is an object of the present invention to provide an improved pumping system for ships. Other and further objects and advantages will appear hereinafter.

DETAILED DESCRIPTION OF THE PREFERRED EMBODIMENT

Figure 1:
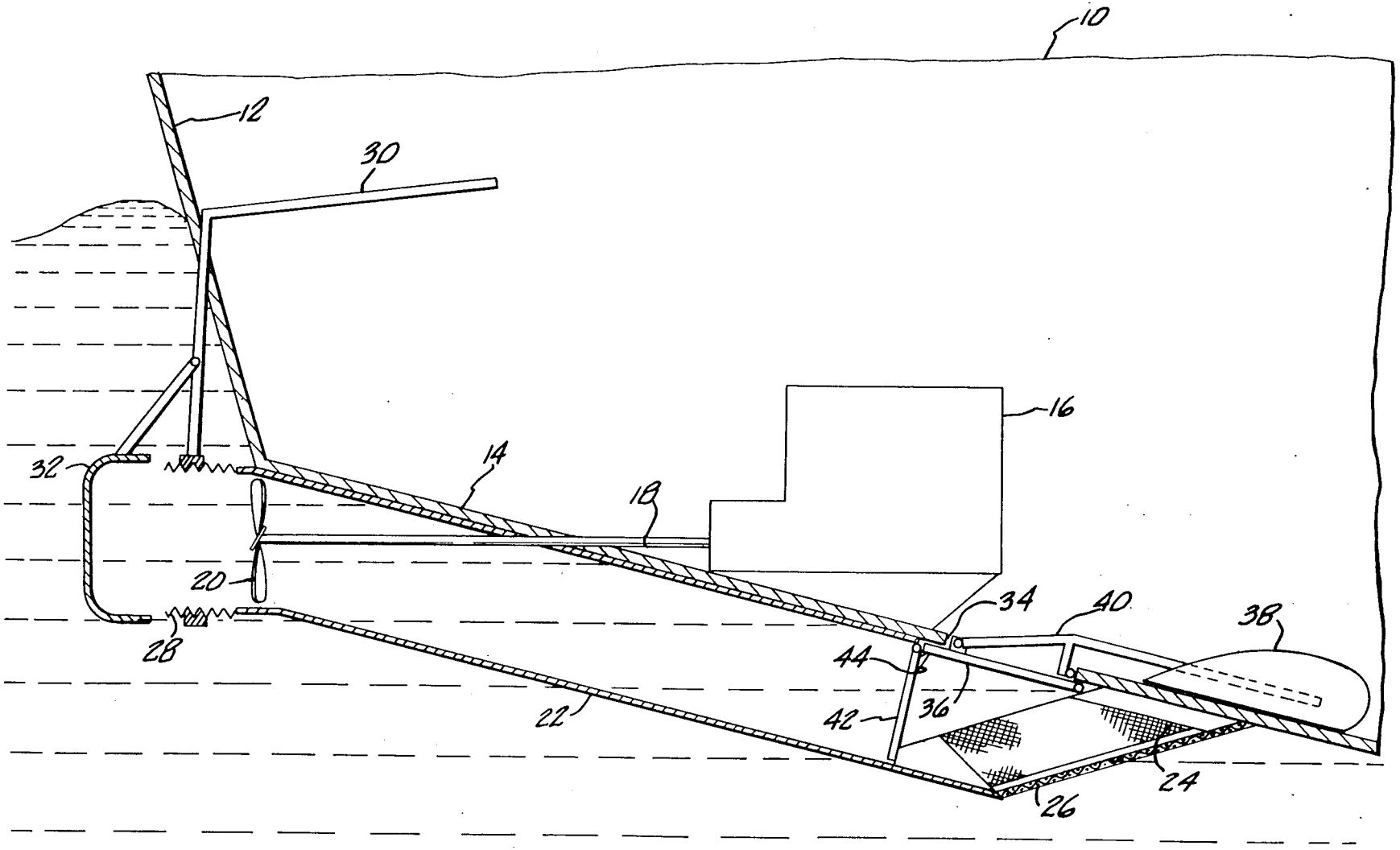
FIG. 1 is a cross-sectional elevation of a portion of a hull incorporating the present invention.

Turning in detail to the drawings, FIG. 1 illustrates a hull 10 having a transom 12 and a bottom 14. Mounted within the hull 10 on the bottom 14 is an engine 16 serving as the propulsion power plant. The engine drives a propeller shaft 18 which extends through the bottom 14 to drive a submerged propeller 20.

Located beneath the bottom 14 and in juxtapostion therewith is a tube 22. The propeller 20 is positioned within the tube 22 adjacent its rearward most extent. The tube 22 extends forwardly from the propeller 20 to a forward inlet 24. In another contemplated embodiment, the tube and propeller system may constitute an axial flow jet pump. A screen or other porous barrier 26 insures that large objects do not reach the propeller 20. Naturally, the tube 22 may take on any appropriate cross section, length and taper as a means for reducing flow friction therethrough and yet extend forwardly enough so that the lower portions of the hull are reached by the tube 22.

Augmenting the propulsion system is a flexible tube 28 extending aft from the tube 22. The flexible tube 28 acts as a steering system through a rudder control 30 schematically illustrated. Through pivoting of the flexible tube 28, directional control may be effected. A reversing shroud 32 is articulated to swing into and out of the jet exhausting from the flexible tube 28 to direct reversing flow forwardly for running the vessel astern.

Figures 2, 3:
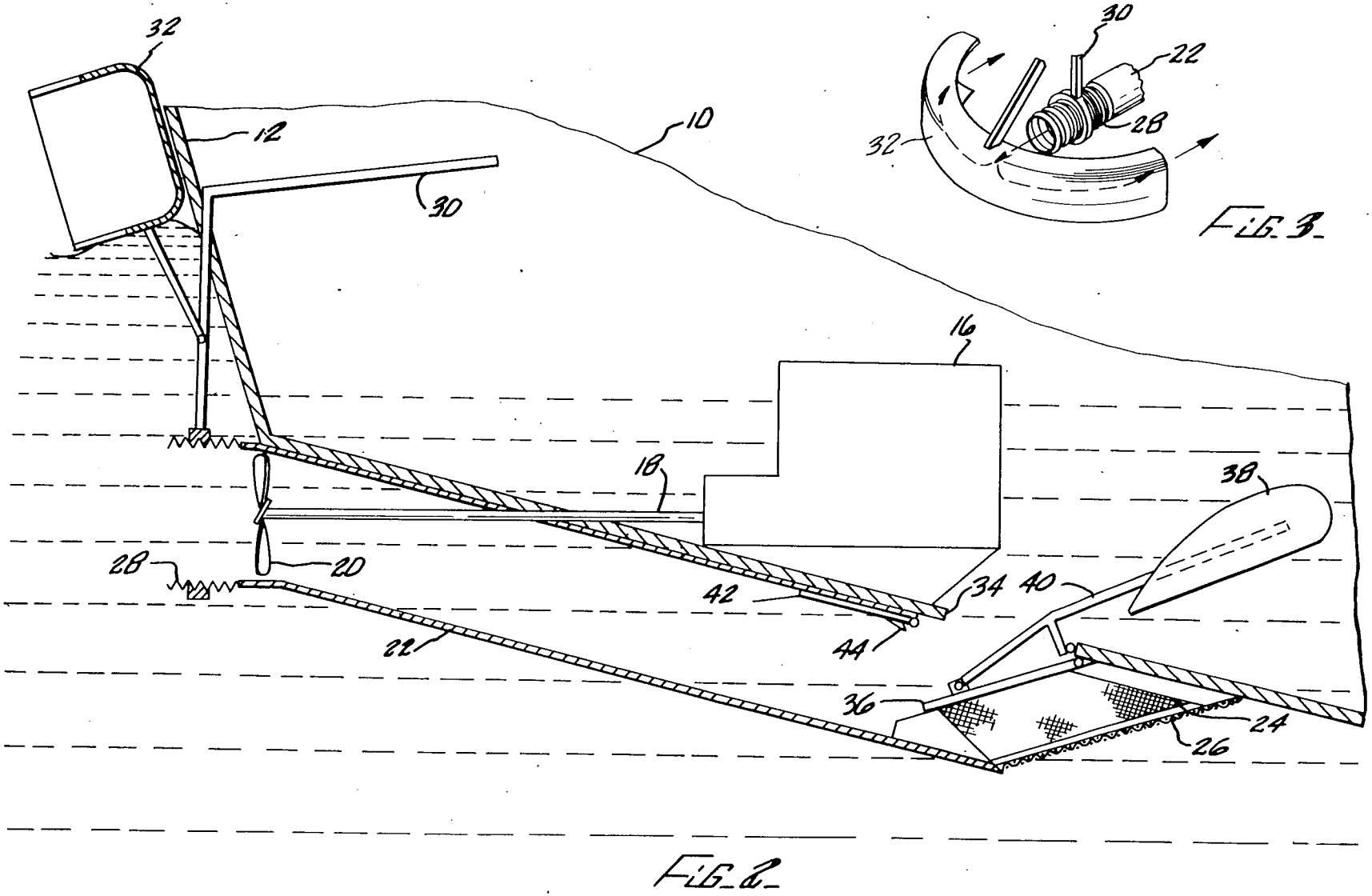
FIG. 2 is a cross-sectional elevation of the device of FIG. 1 illustrating a second operating position.
FIG. 3 is an oblique view of a reversing mechanism to be employed with the present invention.

Located through the bottom 14 of the hull 10 is an opening 34. The opening 34 extends between the lower portion of the hull 10 and the tube 22 so as to provide communication therebetween. The opening 34 is located such that when water accumulates within the bilge for whatever reason, this water may be evacuated through the opening 34. The opening 34 is controlled by a door 36 which is pivotally mounted to the hull. This door 36 is illustrated in FIG. 1 to close off communication through the opening 34 between the hull 10 and the tube 22. In FIG. 2, the door 36 has been pivoted such that communication is established between the interior of the hull 20 and the tube 22 but communication between the tube 22 and its forward inlet 24 has been restricted. To actuate the door 36, a float 38 resides within the hull 10. The float 38 is rigidly coupled to the door 36 by means of a bracket 40. The float 38 is found on the opposite side of the pivot for the door 36 from that door such that an upward movement of the float 38 will result in a downward movement of the door 36. The float 38 may have an aerodynamic shape to help keep the float up when significant flow through the opening 34 exists.

A flow sensor generally provided by pivotally mounted door 42 senses flow through the tube 22. In FIG. 1, no flow is progressing through the tube 22 and the door 42 assumes a position extending across the tube 22. In FIG. 2, flow is experienced through the tube 22 and the door 42 is found to have swung upwardly out of the way against the bottom 14 of the hull 10. Positioned on the flow sensor 42 is a locking means 44. In the present embodiment, this locking means 44 constitutes a simple stop to hold the door 36 in place when no flow is experienced through the tube 22.

Looking to the operation of the pumping system, with the ship in the rest position as can be seen in FIG. 1, the float, under the influence of gravity, has closed the door 36. Appropriate sealing is provided to prevent leakage through that door. The flow sensor 42 does not detect flow through the tube 22 in this condition and the lock 44 further retains the door 36 in its closed position. If the ship commences to sink under these conditions, the float 38 will not rise because of the lock 44. Consequently, the problem would not be compounded by water entering through the opening 34.

When the ship is underway, the sensor 42 swings from its locking position to enable flow of the water surrounding the hull to reach the propeller for propulsion purposes. If the ship hull is filling with water, the float is raised by bouyant force to move the door 36 from its position closing the opening 34. Consequently, the propeller 20 is able to draw water through the tube 22 from the opening 34. Under this condition, the main propulsion system is able to pump water from the bilge of the ship. To enhance this flow through the opening 34, the door 36 may come to rest in the tube 22 so as to shut off the inlet 24. Consequently, all water is being drawn from the hull to feed the propeller. Naturally, as the water recedes within the hull, the float lowers and water may be supplied from both the hull and the external body of water with the door 36 balanced to close when the local dynamic pressure in the tube exceeds the pressure in the bilge.

Thus, an improved pumping system is disclosed. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A pumping system for a boat having a hull and a submerged propeller for propulsion, comprising a tube surrounding the propeller and extending forwardly beneath the hull;

an opening through the hull in communication with the interior of said tube forwardly of the propeller; and a door pivotally mounted relative to the hull within said tube, said door alternatively controlling communication through said opening and communication through said tube forwardly of said opening.

2. A pumping system for a boat having a hull and a submerged propeller for propulsion, comprising a tube surrounding the propeller and extending forwardly beneath the hull;

an opening through the hull in communication with the interior of said tube forwardly of the propeller; and a door pivotally mounted relative to the hull within said tube, said door alternatively controlling communication through said opening and communication through said tube forwardly of said opening and further including a float fixed thereto inwardly of the hull on the opposite side of the pivot from said door.

3. A pumping system for a boat having a hull and a submerged propeller for propulsion, comprising a tube surrounding the propeller and extending forwardly beneath the hull;

an opening through the hull in communication with the interior of said tube forwardly of the propeller;

a door pivotally mounted relative to the hull within said tube, said door alternatively controlling communication through said opening and communication through said tube forwardly of said opening;

a flow sensor in said tube; and locking means controlled by said sensor to lock said door against the hull when no flow is sensed in said tube.

* * * * *